US006372298B1

(12) United States Patent
Marantz et al.

(10) Patent No.: US 6,372,298 B1
(45) Date of Patent: Apr. 16, 2002

(54) HIGH DEPOSITION RATE THERMAL SPRAY USING PLASMA TRANSFERRED WIRE ARC

(75) Inventors: Daniel Richard Marantz, Port Washington; Keith Alan Kowalsky, East Norwich, both of NY (US); David James Cook, Farmington Hills; Larry Gerald Gargol, Ann Arbor, both of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/621,471

(22) Filed: Jul. 21, 2000

(51) Int. Cl.[7] ..... H05H 1/42; C23C 4/12; B05C 5/04

(52) U.S. Cl. ..... 427/449; 239/83; 239/81; 219/76.16; 219/121.5; 219/121.51; 219/121.55; 219/121.59

(58) Field of Search ..... 239/81, 83, 84; 219/76.16, 76.14, 121.51, 121.5, 121.55, 121.59; 427/449

(56) References Cited

U.S. PATENT DOCUMENTS 5,442,153 A 8/1995 Marantz et al.
5,808,270 A 9/1998 Marantz et al.
5,908,670 A * 6/1999 Dunkerley et al. ..... 427/449
5,938,944 A 8/1999 Baughman et al.

* cited by examiner

*Primary Examiner*—Katherine A. Bareford
(74) *Attorney, Agent, or Firm*—Damian Porcari

(57) ABSTRACT

Method of thermally depositing metal at increased rates onto a target surface, comprising: establishing and operating a high velocity plasma transferred wire arc between a cathode and the free-end of a consumable wire electrode, the energy of such plasma and arc being sufficient to not only melt and atomize the free-end of the wire into metal particles, but also project the particles as a column onto the target surface at an enhanced deposition rate for continuous periods in excess of 50 hours; surrounding the plasma and arc with high velocity and high flow gas streams that converge beyond the intersection of the wire free-end with the plasma-arc to limit turbulence of the plasma-arc, avoid direct impingement with the wire and assist the projection of the particles to the target surface; and impinging a low velocity gas flow along the axis of the advancing wire to counteract any destabilizing fluid dynamic forces attempting to move melted particles back along the wire away from the wire free end.

12 Claims, 5 Drawing Sheets

HIGH DEPOSITION RATE THERMAL SPRAY USING PLASMA TRANSFERRED WIRE ARC

BACKGROUND OF THE INVENTION

1. Technical Field

This invention relates to electric arc spraying of metals and, more particularly, to a plasma-arc transferred to a single wire tip that is fed continuously into the plasma-arc.

2. Discussion of the Prior Art

As disclosed in earlier U.S. patents by the co-inventors herein, plasma transferred wire arc is a thermal spray process which melts a continuously advancing feedstock material (usually in the form of a metal wire or rod) by using a constricted plasma-arc to melt only the tip of the wire or rod (connected as an anodic electrode); the melted particles are then propelled to a target. The plasma is a high velocity jet of ionized gas which is desirably constricted and focused about a linear axis by passing it through a nozzle orifice downstream of a cathode electrode; the high current arc, which is struck between the cathodic electrode and the anodic nozzle, is transferred to the wire tip maintained also as an anode. The arc provides the necessary thermal energy to continuously melt the wire tip, and the plasma provides the dynamics to atomize the molten wire tip into highly divided particles and accelerate the melted particles as a stream generally along the axis of the plasma. Acceleration of the particles is assisted by use of highly compressed secondary gas, directed as converging gas streams about the plasma-arc axis, which streams converge at a location immediately downstream of where the wire tip intersects the plasma-arc, but avoid direct impingement with the wire tip to prevent excessive cooling of the plasma-arc.

Existing torches and associated apparatus of the prior art, used to generate the plasma transferred wire arc, lack robustness and are sensitive to instabilities in process parameters resulting in spitting of melted metal rather than spraying of fine particles. Process instabilities occur when one or more of the following are outside of controlled or designed ranges: secondary air flow or pressure, plasma gas pressure, wire feed rate, wire current, and torch movement rate. The occurrence of such instabilities are not fully predictable and can occur early or late in the operational life of the torch.

Spitting results from the accumulation of melted particles which tend to agglomerate and form globules or droplets that move back up along the wire under the influence of fluid dynamics of the plasma jet and secondary gases. Such globules or droplets can contaminate the wire tip and/or release the globules for projection that produces a nonuniform deposit. Process instabilities, that allow particles to agglomerate, may have their origin in a change of electrode shape over time due to wear, buildup of contaminants, or due to irregularities such as the rate of wire feed by the automatic feeding mechanism or changes in the level of current passing through the wire. Such process instabilities correlate with increasing periods of continuous use and higher rates of deposition.

SUMMARY OF THE INVENTION

It is an object of this invention to improve the plasma transferred wire arc process so that it may be operated more robustly to obtain high quality deposits and/or faster deposition rates without any reduction in quality of the deposit.

The invention, in a first aspect, is a method of thermally depositing metal at increased rates onto a target surface, comprising: establishing a high velocity plasma transferred wire arc between a cathode and the free-end of a consumable wire electrode, the energy of such plasma and arc being sufficient to not only melt and atomize the free-end of the wire into fine metal particles, but also project the particles as a column onto such surface at an enhanced deposition rate; surrounding the plasma and arc with high velocity and high flow gas streams that converge beyond the intersection of the wire free-end with the plasma-arc, but avoid direct impingement on the wire free-end; and impinging a low velocity gas flow on the advancing wire to counteract any destabilizing fluid dynamic forces attempting to move the melted metal particles back along the wire away from the wire free-end.

The invention, also, is an improved apparatus for coating a target surface with a dense metallic coating using a plasma transferred wire arc metal spraying process, the apparatus including a cathode, a nozzle generally surrounding a free and of the cathode in spaced relation and having a restricted orifice opposite the cathode to form a plasma, a wire feed mechanism that directs a free end of a wire feedstock into the plasma, a source of electrical energy for striking an arc between the cathode and nozzle for transfer to the free end of the wire, the apparatus further comprising; a plurality of high velocity and high flow gas ports in the nozzle arranged annularly about the orifice to direct secondary gas streams that surround the plasma-arc and converge with respect to the plasma-arc axis at a location beyond the wire free-end but which do not impinge directly on the wire free-end; and means providing at least one low velocity gas flow that directly impinges near the wire free-end to counteract any dynamic vector forces urging the melted particles back along the wire.

DETAILED DESCRIPTION AND BEST MODE

Figure 1:
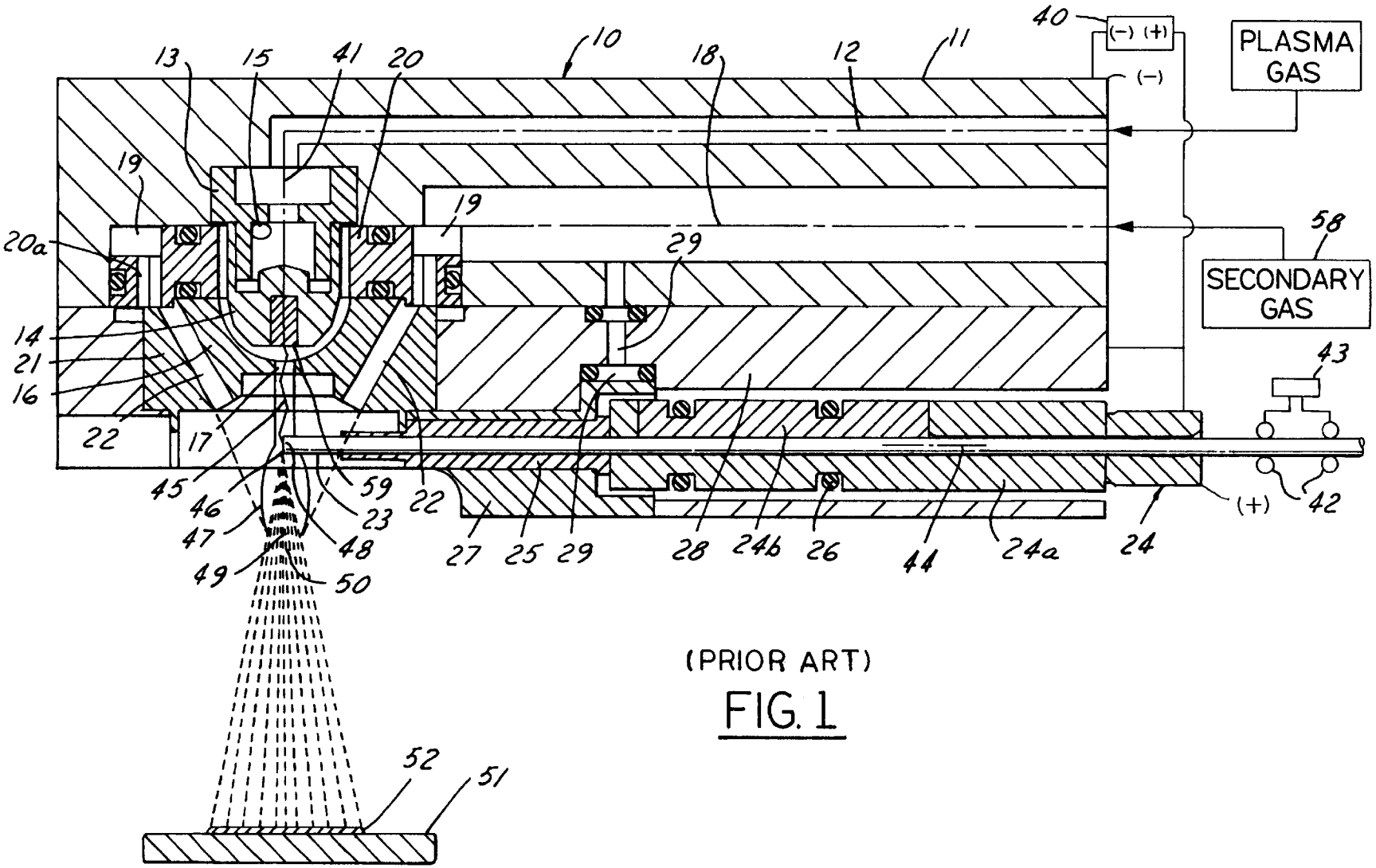
(PRIOR ART) FIG. 1
FIG. 1 is a schematic representation of a prior art transferred plasma-arc torch configuration producing an extended plasma-arc with vortex flow.

The transferred plasma-arc torch assembly 10 consists of a torch body 11 containing a plasma gas port 12 and a secondary gas port 18; the torch body 11 is formed of an electrically conductive metal. The plasma gas is connected by means of port 12 to a cathode holder 13 through which the plasma gas flows into the inside of the cathode assembly 14 and exits through tangential ports 15 located in the cathode holder 13. The plasma gas forms a vortex flow between the outside of the cathode assembly 14 and the internal surface of the pilot plasma nozzle 16 and then exits through the constricting orifice 17. The plasma gas vortex provides substantial cooling of the heat being dissipated by the cathode function.

Secondary gas enters the torch assembly through gas inlet port 18 which directs the secondary gas to a gas manifold 19

(a cavity formed between baffle plate 20 and torch body 11 and thence through bores 20*a* into another manifold 21 containing bores 22). The secondary gas flow is uniformly distributed through the equi-angularly spaced bores 22 concentrically surrounding the outside of the constricting orifice 17. The flow of the secondary gas through the equi-angularly spaced bores 22 (within the pilot nozzle 16) provides cooling to the pilot nozzle 16 and provides minimum disturbance to the plasma-arc, which limits turbulence.

A wire feedstock 23 is fed (by wire pushing and pulling feed rollers 42, driven by a speed controlled motor 43) uniformly and constantly through a wire contact tip 24, the purpose of which is to make firm electrical contact to the wire feedstock 23 as it slides through the wire contact tip 24; in this embodiment it is composed of two pieces ,24*a* and 24*b*, held in spring or pressure load contact with the wire feedstock 23 by means of rubber rings 26 or other suitable means. The wire contact tip 24 is made of high electrical conducting material. As the wire exits the wire contact tip 24, it enters a wire guide tip 25 for guiding the wire feedstock 23 into precise alignment with axial centerline 41 of the critical orifice 17. The wire guide tip 25 is supported in a wire guide tip block 27 contained within an insulating block 28 which provides electrical insulation between the main body 11 which is held at a negative electrical potential, while the wire guide tip block 27 and the wire contact tip 24 are held at a positive potential. A small port 29 in the insulator block 28 allows a small amount of secondary gas to be diverted through wire guide tip block 27 in order to provide heat removal from the block 27. The wire guide tip block 27 is maintained in pressure contact with the pilot nozzle 16 to provide an electrical connection between the pilot nozzle 16 and the wire guide tip block 27. Electrical connection is made to the main body 11 and thereby to the cathode assembly 14 (having cathode 59) through the cathode holder 13 from the negative terminal of the power supply 40; the power supply may contain both a pilot power supply and a main power supply operated through isolation contactors, not shown. Positive electrical connection is made to the wire contact tip 24 and block 28 of the transferred plasma-arc torch from the positive terminal of the power supply 40. Wire feedstock 23 is fed toward the centerline 41 of orifice 17, which is also the axis of the extended arc 46; concurrently, the cathode assembly 14 is electrically energized with a negative charge and the wire 23, as well as the nozzle 16, is electrically charged with a positive charge. The torch may be desirably mounted on a power rotating support (not shown) which revolves the gun around the wire axis 44 to coat the interior of bores. Additional features of a commercial torch assembly are set forth in U.S. Pat. No. 5,938,944, the disclosure of which is incorporated herein by reference.

To initiate operation of the torch, plasma gas is caused to flow through port 12, creating a vortex about the nozzle and then, after an initial period of time of approximately two seconds, high-voltage d.c. power or high frequency power is connected to the electrodes causing a pilot plasma to be momentarily activated. Additional energy is then added to the pilot plasma by use of a plasma gas of between 110 and 130 psi and a current to the electrodes of between 60 and 85 amps, as set forth in U.S. Pat. No. 5,938,944, to extend the plasma-arc providing an electrical path 45 for the plasma-arc to transfer from the nozzle to the wire tip or free-end 57. Wire is fed by means of wire feed rolls 42 into the extended transferred plasma-arc sustaining it even as the wire free-end is melted off by the intense heat of the transferred arc 46 and its associated plasma 47 which surrounds the transferred arc 46. Molten metal particles 48 are formed on the tip end of the wire 23 and are atomized into fine, particles 50 by the viscous shear force established between the high velocity, supersonic plasma jet and the initially stationary molten droplets. The molten particles 48 are further atomized and accelerated by the much larger mass flow of secondary gas through bores 22 which converge at a location or zone 49 beyond the flow of the plasma 47, now containing the finely divided particles 50, which are propelled to the substrate surface 51 to form a deposit 52.

In the most stable condition of the thermal spraying process, wire 10 will be melted and particles 48 will be formed and immediately carried and accelerated along centerline 41 by vector flow forces 53 in the same direction as the supersonic effluent plasma gas 47; a uniform deposit 52 of fine particles, without aberrant globules, will be obtained. The vector forces 53 are the axial force components of the plasma-arc energy and the high level converging secondary gas streams. However, under some conditions instabilities occur where particles 48, from the melted wire tip, are carried up along the axis 55 of the wire away from the wire free-end 57, transverse to the centerline 41 and axis of the plasma-arc. The particles agglomerate as droplets or globules 56 and either buildup on the wire guide tip 27 and/or are jarred loose to be propelled as large agglomerate masses toward the substrate 51. Transverse vector flow forces 54 (which may be due to the fluid dynamics of the secondary gas flows and/or plasma-arc) act to carry the droplets or globules 49 along the wire surface, parallel to the wire axis 55, demonstrated in FIG. 2.

Figure 2:
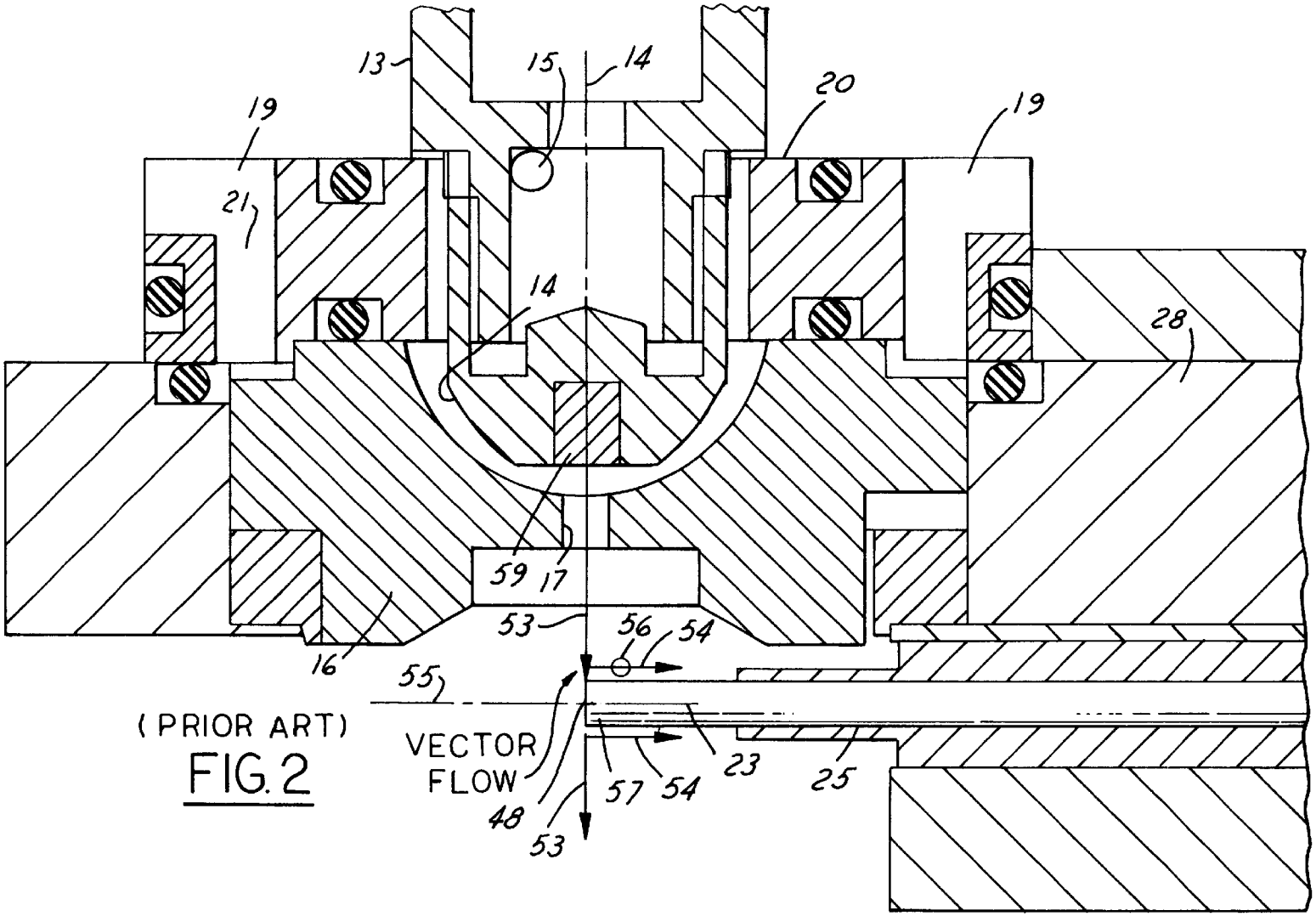
(PRIOR ART) FIG. 2
FIG. 2 is an enlarged representation of the nozzle and wire free-end of FIG. 1, illustrating vector forces that arise due to instability in the process.

As indicated earlier, secondary high velocity and high flow gas is released from equi-angularly spaced bores 22 to project a curtain of gas streams about the plasma-arc. The supply 58 of secondary gas, such as air, is introduced into chamber 19 under high velocity and flow, with a pressure of about 30–90 psi at each port 22. Chamber 19 acts as a plenum to distribute the secondary gas to the series of angularly spaced nozzle bores 22 which direct the gas as concentric converging streams which assist the acceleration of the particles 50. Each port has an internal diameter of about 0.073 inches and emit a high velocity air flow at a flow rate of about 40 cfm for all the ports combined. The plurality of bores 22, typically ten in number, are located concentrically around the pilot nozzle orifice 17, and are radially spaced apart about 36 degrees. To avoid excessive cooling of the plasma-arc, these streams are radially located so as not to impinge directly on the wire free-end 57 (see FIG. 4). The bores 22 are spaced angularly apart so that the wire free-end 57 is centered midway between two adjacent bores, when viewed along centerline 41. Thus, as shown in FIG. 2, bores 22 will not appear because the section plane is through the wire; FIG. 1 shows the bores 22 only for illustration purposes and it should be understood they are shown out of position and are not in the section plane for this view. The converging angle of the gas streams is typically about 30 degrees relative to the centerline 41, permitting the gas streams to engage the particles downstream of the wire-plasma intersection zone 49. Such angular disposition is relatively transverse (i.e. 60 degrees) to the axis 55 of the wire; any stray impingements of the gas streams with the wire will be insufficient to counteract vector forces tending to move droplets 56 back up along the wire.

Figure 3:
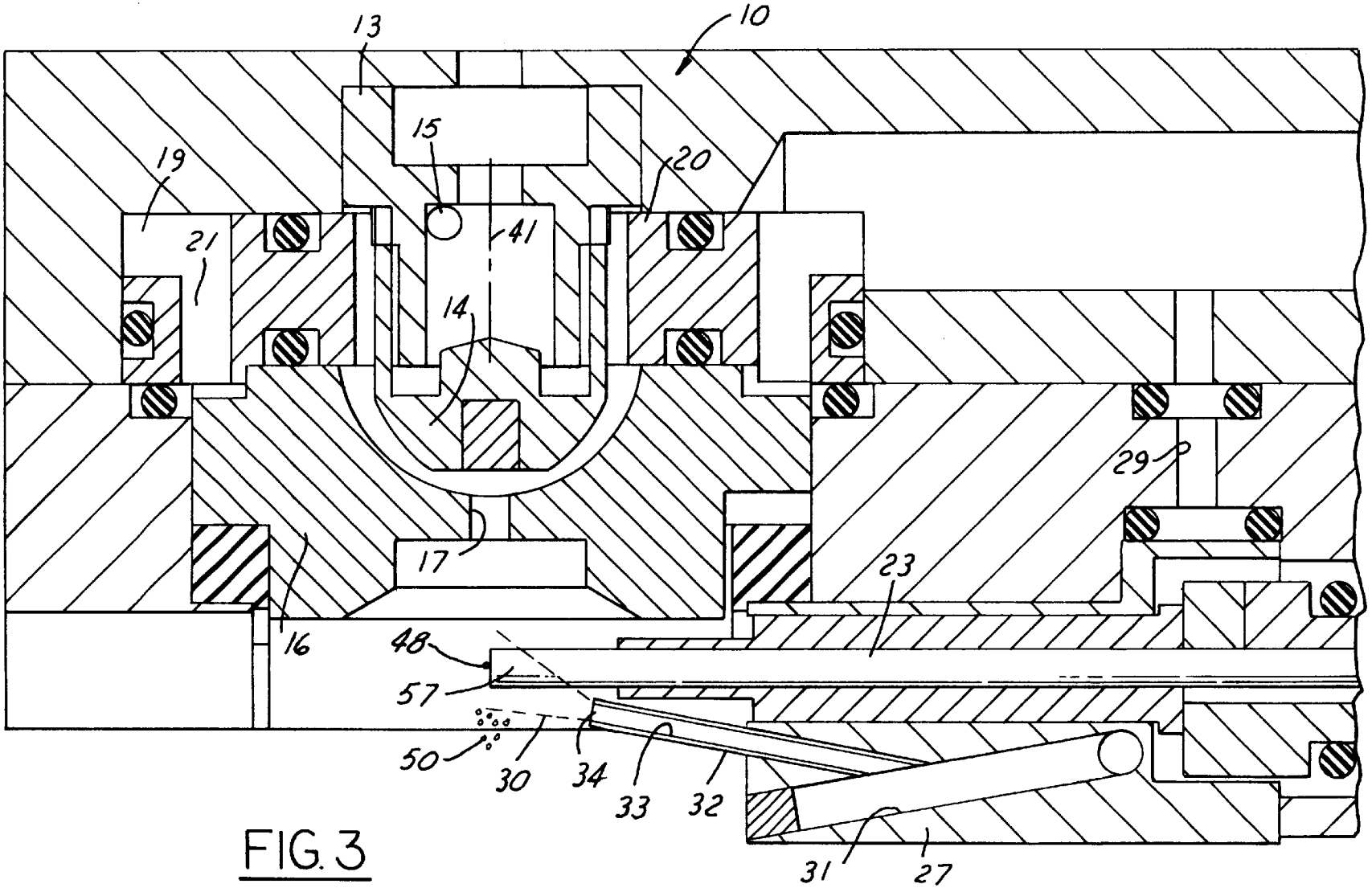
FIG. 3 is a view like that in FIG. 2 showing a first modification, according to this invention, which overcomes the instabilities of FIG. 2.

To avoid process instabilities at most process parameters, and particularly at elevated wire feed rates, a low velocity gas flow is impinged near the wire free-end 57 and directed along the axis 55 of the wire to counteract any destabilizing dynamic forces attempting to move atomized particles back up along the wire away from the wire free-end. To this end (as shown in FIG. 3), an air passage 31 is drilled in the end of wire tip guide block 25 to communicate with the air passage 29 normally used to cool the wire tip assembly. An air tube or passage 32 is then formed to communicate with passage 31 and direct a low velocity air flow 30 onto the wire free-end onto the side of the wire tip opposite from the direction from which the high velocity secondary gas flow is coming. The tube 32 has an internal diameter 33 of about 0.020 inches and an air flow that is stepped down to a flow of about 1–2 cfm. The tip 34 of the tube may be positioned as close as about 0.2 inches to the wire free-end. The tube may be positioned so that the impinging gas flow emanates from a passage aligned with the wire in a direction making an angle of about 15 degrees therewith, such that the axis of the tube forms the 15 degree angle with the axis of the wire. The low velocity air flow 30 acts in opposition to force vector 54 to retain melted droplets 56 at the wire free-end ready for immediate acceleration and propulsion to the surface 51. Such additional air passages (31,32) can be incorporated into the wire guide block, with or without an extended tube, to impinge the low velocity air flow on the side of the wire in a direction counter to vector 54.

Figure 4:
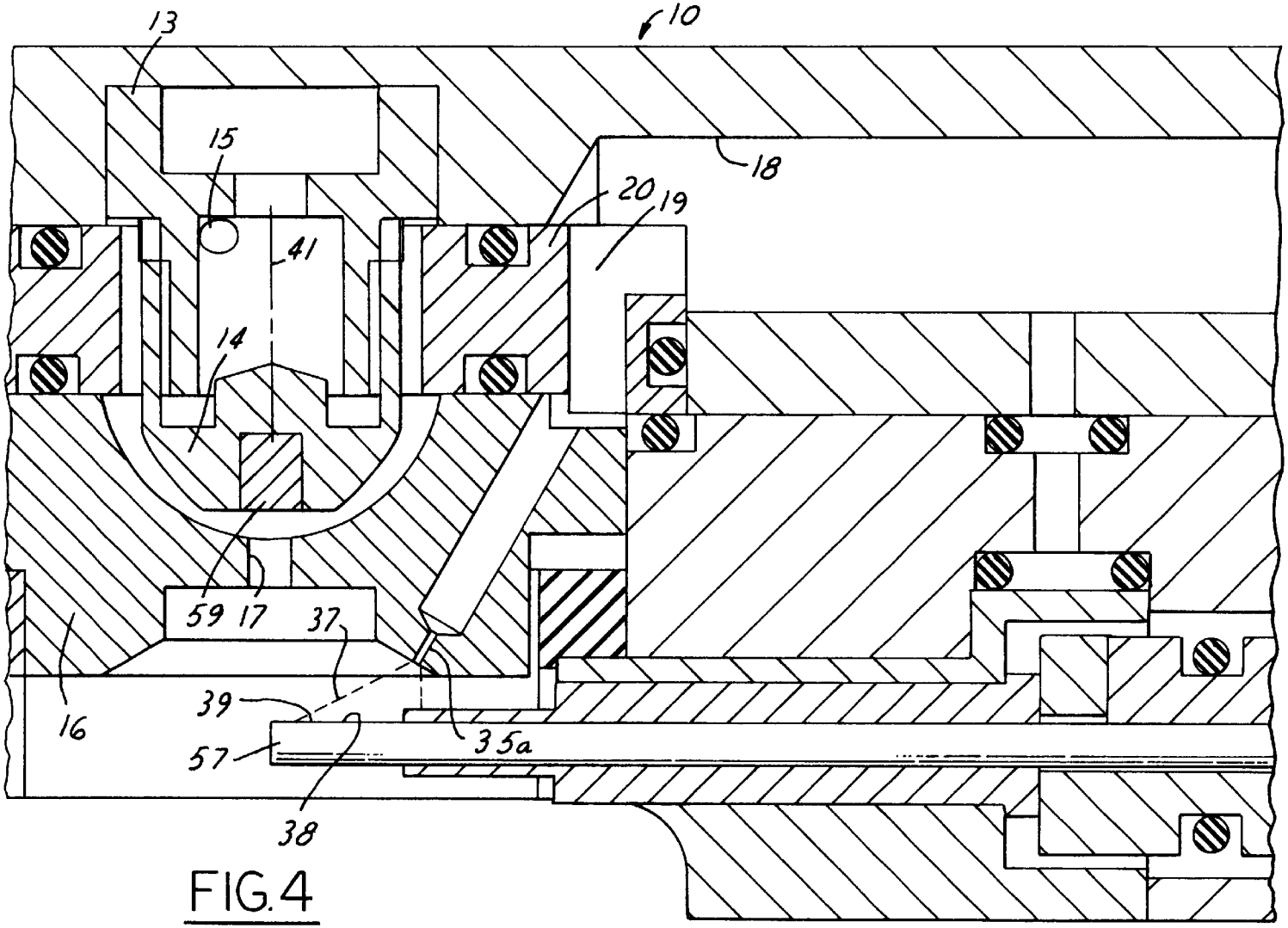
FIG. 4 is a view like that in FIG. 2, showing an alternative modification according to this invention, which also overcomes the instabilities of FIG. 2.
Figure 5:
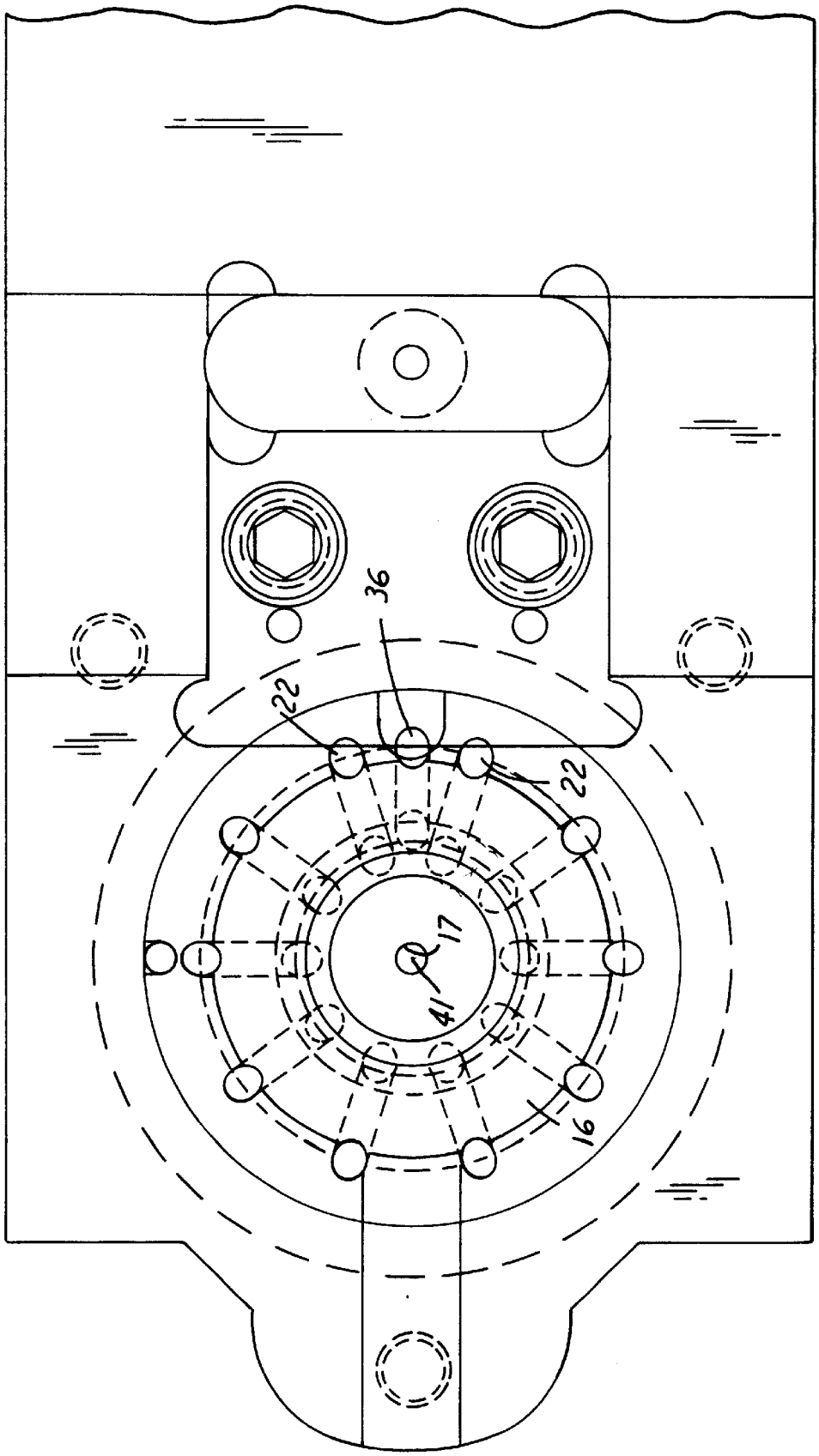
FIG. 5 is a side elevational view of the torch showing the annular arrangement of the high velocity and high flow secondary ports and the single low velocity flow port.

An alternative (as shown in FIGS. 4–5) is to add a small passage 35 in the pilot nozzle 16 at a position 36 between adjacent bores 22 in alignment (parallel to centerline 41) with the wire free-end so that a low velocity air flow 37 will impinge on the side 38 of the wire, as shown in FIG. 4. Passage 33 of FIG. 3 or passage 35 of FIG. 4 will allow the plasma transferred wire arc process to run in a stable condition under varying and even non-controlled process parameters.

Importantly, such modifications allow the torch to operate with much greater robustness, being sensitive ti instabilities in process parameters. The torch can also be operated at much higher wire feed/deposition rates, more than 50 percent greater than prior art torches, while experiencing no decrease in deposit quality and no spitting. For example, deposition (wire feed rate) of 250 inches per minute can now be achieved for continuous periods of 100 hours or more, as opposed to only 160 inches per minute for shorter periods of continuous use by the prior art. The wire feed rate may be in the range of 200 to 250 inches per minute while the apparatus is operated for a continuous period of 50–150 hours. The deposition rate may also be 200 to 275 inches per minute. If the wire has a diameter of 0.062 inches, the deposition rate may be in the range of 8 to 12 pounds per hour. Advantageously, the low velocity air flows 30 or 37 impinge on the wire free-end at a location 39 outside the envelope of the gas streams, from bores 22, to avoid any unnecessary cooling of the plasma-arc; but the low velocity flows, 30 and 37, are angled transverse to the wire to provide a flow vector component that is effective to counter any fluid dynamnic forces attempting to move melted particles back along the wire. While the best mode and viable alternatives for carrying out the invention have been described in detail, those familiar with the art to which this invention relates will recognize various alternative designs and variations for the practicing the invention as defined by the following claims.

What is claimed is:

1. A method of thermally depositing metal at increased rates onto a target surface, comprising:

(a) establishing and operating a plasma transferred wire arc between a cathode and the free end of a consumable wire electrode, the energy of such plasma and arc being sufficient to not only melt and atomize the free-end of the wire into metal particles, but also project the particles as a column onto said target surface at a wire feed rate of 200–250 inches per minute for continuous periods in excess of 50 hours;

(b) surrounding the plasma and arc with gas streams that converge beyond the intersection of the wire free-end with the plasma-arc, but avoid direct impingement with the wire and assist the projection of the particles to the target surface; and (c) impinging a gas flow of about 1–2 cfm onto and near the tip of the advancing wire to counteract any destabilizing dynamic forces resulting from the energy of said plasma and arc, which forces attempt to move melted particles back along the wire away from the wire free-end.

2. The method as in claim 1, in which in step (b) said gas streams have a high velocity flow of about 40 cfm.

3. The method as in claim 1, in which in step (a) the energy of said plasma and arc is created by use of a plasma gas having a pressure of between 110 and 130 psi and a current to said cathode and wire electrode of between 60 and 85 amps.

4. The method as in claim 1, in which said impinging gas flow is directed along a path that impinges on the wire with a flow vector effective to counter any energy force vectors attempting to move melted particles back along the wire.

5. The method as in claim 1, in which said impinging gas flow emanates from a passage aligned with the wire in a direction making an angle of about 15 degrees therewith.

6. The method as in claim 1, in which said impinging flow is carried by a tube having its end spaced from the free-end of the wire a distance up about 0.2 inches and has an axis which is aimed at the wire free-end at an angle of about 15 degrees with respect to the axis of the wire.

7. A method of coating a target surface with a dense metallic coating using a plasma transferred wire arc thermal spraying apparatus, the apparatus including a cathode, a nozzle generally surrounding a free-end of the cathode in spaced relation and having a restricted orifice opposite the cathode to direct a plasma, a wire feed mechanism that directs a free-end of a wire feedstock into the plasma-arc, a source of electrical energy for striking an arc between the cathode and nozzle for transfer to the free-end of the wire, and a plurality of gas ports in the nozzle and arranged around the nozzle orifice to project a surrounding curtain of secondary gas streams that converge with respect to the plasma-arc axis to intersect at a location beyond the wire free-end, comprising:

(a) directing plasma gas into the nozzle while increasing the electrical potential difference between the cathode and nozzle to project an extended plasma-arc out of the nozzle orifice;

(b) transferring the extended arc and resulting plasma jet to the wire free-end by maintaining the wire free end at essentially the same electrical potential as the nozzle which results in melting and atomization of the wire free-end into fine particles;

(c) projecting the atomized metal particles onto the target surface by influence of the projection energy of the transferred plasma-arc and the surrounding curtain of secondary gas flow which are unable to counter any energy vector forces influencing the atomized particles to move back along the wire; and (d) impinging an additional secondary gas flow onto the wire free-end that counteracts any said energy vector forces urging the melted particles back along the wire.

8. The method as in claim 7, in which said impinging gas flow has a flow rate of about 1–2 cfm and emanates from an orifice having a diameter of about 0.020 inches, while the secondary gas flows have a combined flow rate of about 40 cfm and emanate from an orifice having a diameter of about 0.073 inches.

9. The method as in claim 7, in which said secondary gas flows emanate from an plurality of annularly arranged ports equally spaced about the axis of said plasma-arc, and the wire feedstock has an axis that is spaced between the flow projection of any such ports.

10. The method as in claim 7, in which said wire feed rate is in the range of 200–250 inches per minute while the apparatus is operated for a continuous period of 50–150 hours.

11. The method as in claim 7, in which said wire has a diameter of about 0.062 inches and the deposition rate is in the range of 8–12 pounds per hour.

12. An improved apparatus for coating a target surface with a dense metallic coating using a plasma transferred wire arc thermal spraying process, the apparatus including a cathode, a nozzle generally surrounding a free end of the cathode in spaced relation and having a restricted orifice opposite the cathode to form a plasma, a wire feed mechanism that directs a free end of a wire feedstock into the plasma, a source of electrical energy for striking an arc between the cathode and nozzle for transfer to the free end of the wire, the improved apparatus further comprising:

(a) a plurality of gas ports in the nozzle arranged annularly about the orifice to direct secondary gas streams that surround the plasma-arc and converge with respect to the plasma-arc axis at a location beyond the wire free-end but which do not impinge directly on the wire free-end, and (b) means providing at least one low velocity gas flow that impinges near the wire free-end to counteract any fluid dynamic vector forces urging the melted particles back along the wire.

* * * * *